US006280267B1

(12) United States Patent
Griffith, Sr. et al.

(10) Patent No.: US 6,280,267 B1
(45) Date of Patent: Aug. 28, 2001

(54) RETRACTABLE TROLLING MOTOR

(75) Inventors: Thomas E. Griffith, Sr., Florence, MS (US); David D. Jones, Lake Forest, IL (US); Calvin Tyler, Gadsden, AL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/540,683

(22) Filed: Mar. 31, 2000

(51) Int. Cl.[7] ..... B63H 20/08

(52) U.S. Cl. ..... 440/53; 440/6

(58) Field of Search ..... 440/6, 7, 53; 114/144 E, 114/144 B

(56) References Cited

U.S. PATENT DOCUMENTS 4,668,195 * 5/1987 Smith ..... 440/6
5,892,338 * 4/1999 Moore et al. ..... 440/7

* cited by examiner

*Primary Examiner*—Jesus D. Sotelo
(74) *Attorney, Agent, or Firm*—Fletcher, Yoder & Van Someren

(57) ABSTRACT

A propulsion system for a watercraft is provided, which may be an integral part of a watercraft or may be retrofitted to a particular watercraft. The propulsion system is mounted to the hull in a central area, such as forward of a transverse centerline of the hull. The propulsion system includes a propulsion assembly coupled to a retractable arm, which is pivotable between a stowed and operational position. In the stowed position at least a portion of the propulsion assembly may be received within a recessional housing formed in the hull.

27 Claims, 4 Drawing Sheets

RETRACTABLE TROLLING MOTOR

BACKGROUND OF THE INVENTION

1. Field of the Invention

The present invention relates generally to electric propulsion units for recreational watercraft. More specifically, the present invention relates to propulsion units which mount in a forward area of the watercraft.

2. Description of the Related Art

Recreational watercraft are typically used for a variety of activities such as fishing, cruising, water skiing, and so forth. To move the watercraft across the water, an adequate amount of thrust is necessary depending on the particular activity. The thrust may be provided by a variety of propulsion systems, typically electrically or mechanically powered. Mechanical propulsion systems generally include outboard or inboard/outboard engine-driven propeller systems. In the field of propulsion systems for watercraft, and particularly for pleasure craft, various electrical and mechanical propulsion devices have been proposed and adopted for use. In general, such systems include internal combustion engines drives and electric drives.

Internal combustion engine drives are generally disposed at the rear of a watercraft at a transom, either outboard or inboard. Outboard motors are typically secured to the transom of a boat, while inboard motors have a propeller extending through the transom from an internal combustion engine disposed within a housing of the hull. Both outboard and inboard motors are particularly useful for high-speed and highly responsive navigation of the watercraft. Drawbacks of such drives, however, include their noise levels, exhaust emissions, relative complexity, size and weight.

Electric propulsion systems for pleasure craft are typically referred to as trolling motors or electric outboards. These systems include an electric motor which can be rotated at various speeds to drive a prop. The prop produces a thrust which is directed by proper orientation of the propulsion unit. In conventional trolling motors, for example, a control head may be manually oriented to navigate the boat in a desired direction, or a remote control assembly may be provided for rotating a support tube which holds the propulsion unit submerged during use. While certain relatively minor differences may exist, the term electric outboard is typically employed for the conventional trolling motor design, but with a horsepower range elevated with respect to the conventional trolling motor, such as in excess of 1 horsepower.

While the conventional trolling motor provides quiet and reliable navigation, extremely usefull for certain activities such as fishing, there is considerable room for improvement. For example, conventional trolling motors are typically after-market add-on units designed for mounting on the deck of a watercraft. Such units are typically supported by a mounting structure, a wide range of which may be obtained commercially, which allows for relatively straightforward deployment of the motor to position the propulsion unit below the waterline alongside the deck, and retraction of the unit for storage on the deck. The entire motor and mount, however, generally remain securely fixed to the deck, both during use and storage. The resulting structure is somewhat cumbersome and occupies useful space on the deck, limiting access to the water in the area of the motor mount. Moreover, while much energy and creativity have been invested in boat designs, the aesthetics and aerodynamics of the hull may be somewhat impaired by the trolling motor and mount positioned on the deck, typically adjacent to the bow. Furthermore, conventional trolling motors only provide thrust at a point adjacent to the perimeter of a watercraft, thereby allowing external forces such as wind to force the watercraft out of alignment with the desired direction of movement across the water.

SUMMARY OF THE INVENTION

The present invention provides a propulsion system for a watercraft designed to address these drawbacks. The propulsion system may be an integral part of a watercraft or may be retrofitted to existing designs. The propulsion system is preferably mounted to the hull in a central area, rather than along the perimeter of the watercraft. This frees deck space, and removes the trolling motor typically mounted to the deck. The propulsion system may be used as a primary thrust source, an alternative thrust source, a correctional steering thrust source, or in other specialized applications.

The propulsion system includes a propulsion assembly coupled to a retractable arm, which is pivotable between a stowed position and an operational position. The propulsion assembly may be configured for an inboard or an outboard drive, either electrical or mechanical, and preferably has a prop to provide thrust. The propulsion assembly may also be configured for one or more drive units for pivoting the assembly, and for rotating the assembly to a desired direction.

The propulsion assembly is stowed at a stowed position, in which a portion of the assembly fits within a recessional housing in the hull of the watercraft. The recessional housing may be an integral part of the watercraft, or it may be retrofitted to a particular watercraft. The recessional housing stows the propulsion assembly while non-operational, and may provide access to the assembly for maintenance and cleaning, and may reduce drag.

The propulsion system may also be configured for interconnection with a control system. An exemplary control system may include a control panel with instruments, and a foot pedal for hands-free operation.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
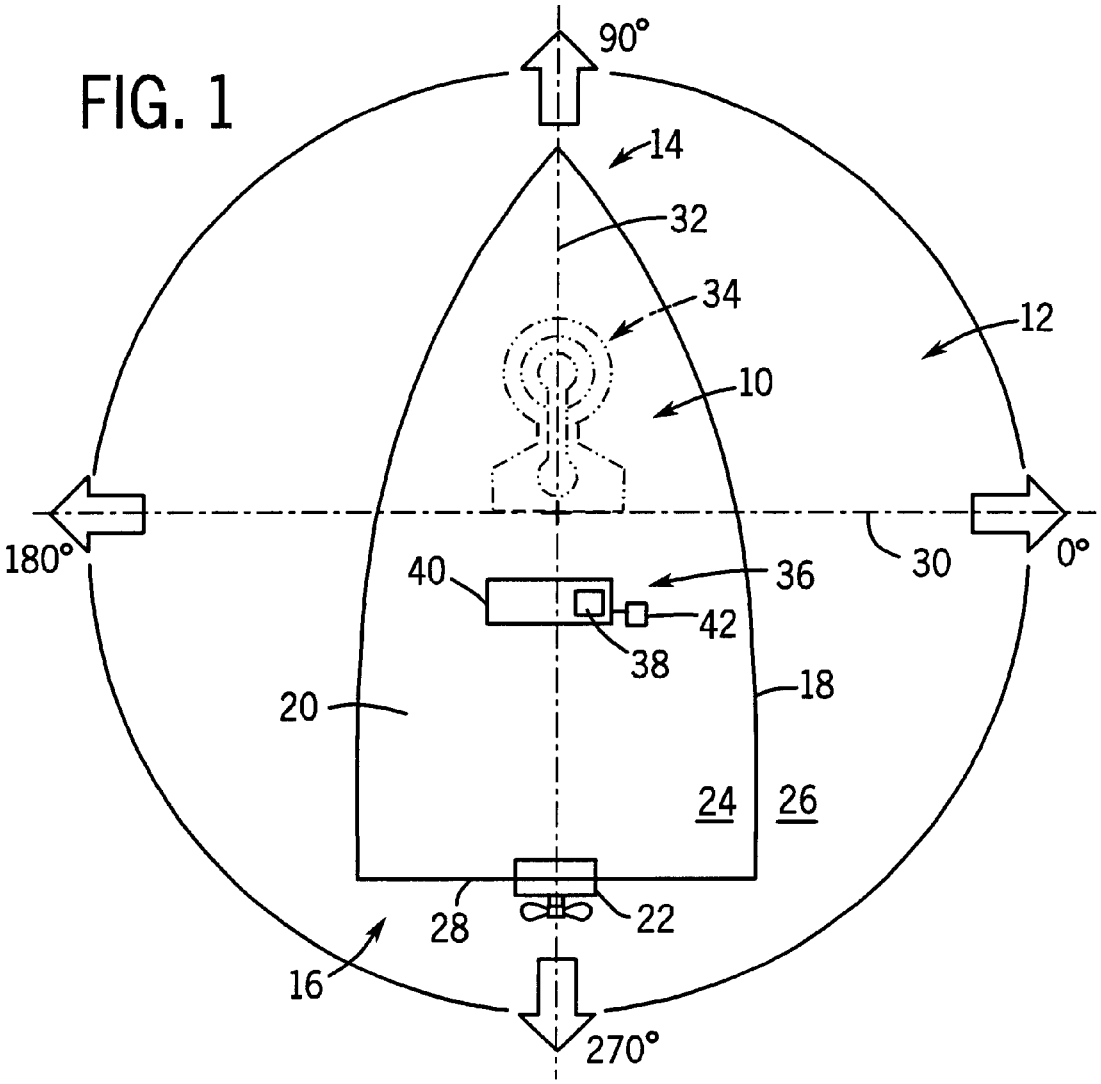
FIG. 1 illustrates a top view of an embodiment of a propulsion system, which is adapted for and disposed in a watercraft.

Turning now to the drawings, FIG. 1 illustrates a top view of a propulsion system 10 adapted for and disposed in a watercraft 12. The watercraft 12 has a bow 14, a stem 16, a hull 18, and a cabin 20. The watercraft 12 may also have a rear propulsion unit or motor 22, mounted either inboard 24 or outboard 26 at a transom 28. For orientation purposes, FIG. 1 illustrates the watercraft 12 as having a transverse centerline 30 and a longitudinal centerline 32. The propulsion system 10 preferably includes a propulsion assembly 34 mounted to the hull 18 forward the transverse centerline 30. The propulsion system 10 may also have a control system 36, which may include instruments 38 disposed on a console 40 and a foot pedal 42 for hands-free control of the propulsion assembly 34. These components of the system may be similar to those currently available for control of conventional trolling motors and electric outboards.

Figure 2:
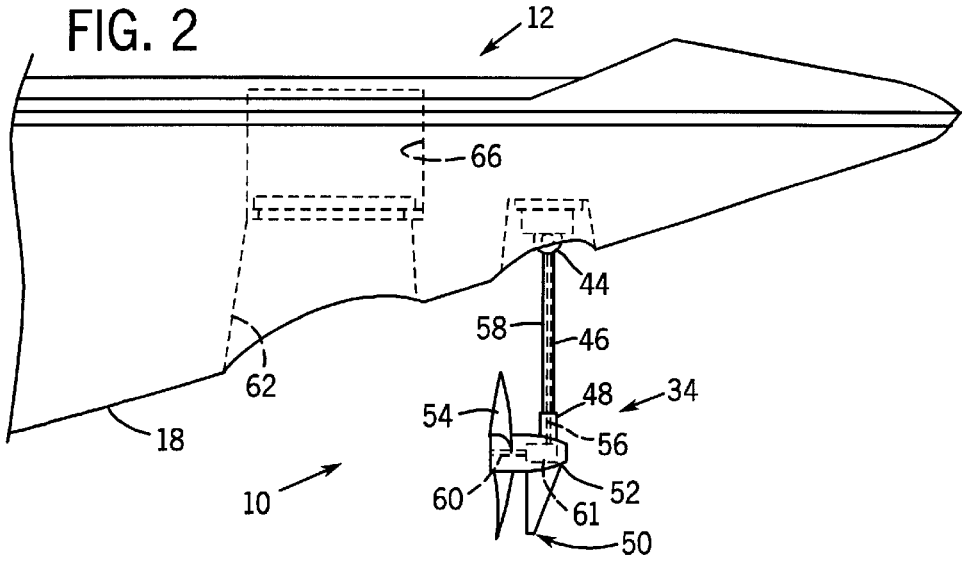
FIG. 2 illustrates a side view of an embodiment of the propulsion assembly extending outwardly from the hull in an operational position.

FIG. 2 illustrates a side view of an embodiment of the propulsion assembly 34 extending outwardly from the hull 18 in an operational position. The propulsion assembly 34 preferably includes a pivotable joint assembly 44, and a retractable arm 46 extending outwardly from the pivotable joint assembly 44 to an end 48. As illustrated, the propulsion assembly 34 is in an operational or thrust position 50 for displacing water to produce thrust for correctively or assistingly steering the watercraft 10.

A housing 52 is coupled to the retractable arm 46 at the end 48, and a prop 54 is rotatably coupled to the housing 52 substantially perpendicular to the retractable arm 46. The prop 54 is drivingly coupled to a power transmission assembly 56 extending through the housing 52 and the retractable arm 46. The power transmission assembly 56 includes a drive shaft 58 disposed in the retractable arm 46, a drive shaft 60 disposed in the housing 52, and a gearbox 61 coupling the drive shafts 58 and 60. As illustrated, the drive shafts 58 and 60 are rigid. The power transmission assembly 56 also has bearings (not shown in detail) disposed about the drive shafts 58 and 60. The propulsion system 10, as illustrated, also includes a recessional housing 62 for stowing the propulsion assembly 34 while not in use.

In this embodiment, the pivotable joint assembly 44 is preferably a sealed gimble assembly. However, a variety of other sealed joint assemblies are contemplated for the pivotable joint 44. For example, a flexible boot (e.g., rubber) may be used to provide a continuous seal while the retractable arm 46 is pivoted. The pivotable joint assembly 44 may also have a simple pin joint or a ball and socket joint, or even a gearbox for engaging the drive shaft 58. Furthermore, a flexible shaft assembly may be used for the power transmission assembly 56 to provide flexibility at the pivotable joint assembly 44. As will be appreciated by those skilled in the art, such flexible shaft assemblies generally include a support tube or sheath and a central drive shaft rotatable within the sheath, both of which are flexible.

Figure 3:
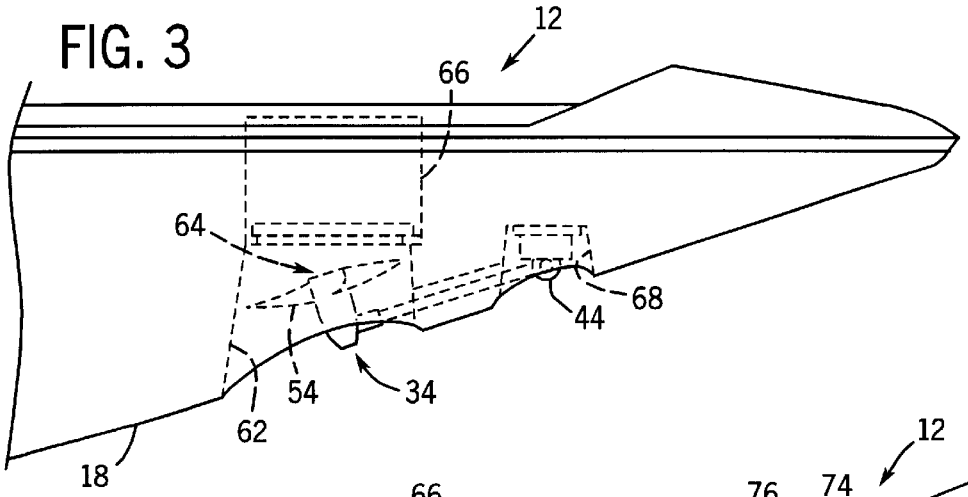
FIG. 3 illustrates a side view of an embodiment of the propulsion assembly in a stowed position partially within a recessional housing of the hull.

FIG. 3 illustrates a side view of an embodiment of the propulsion assembly 34 in a stowed position 64 partially within the recessional housing 62. The propulsion assembly 34 is retractable into the recessional housing 62 by pivoting about the pivotable joint assembly 44. A well 66 may be accessible from the cabin 20 (see FIG. 1) at a location over the recessional housing 62. In the open position, a hatch (not shown) over well 66 provides access to the propulsion assembly 34. The propulsion assembly 34 is preferably locked into the stowed position while not in use, either automatically or manually, such as within well 66. For example, electrical-mechanical locks could be triggered once the propulsion assembly 34 reaches the stowed position 64, or a user could manually lock the propulsion assembly 34 within the recessional housing 62. While in the stowed position, the prop 54 is accessible within the well 66, allowing for maintenance, such as weed removal from the prop 54.

Figure 4:
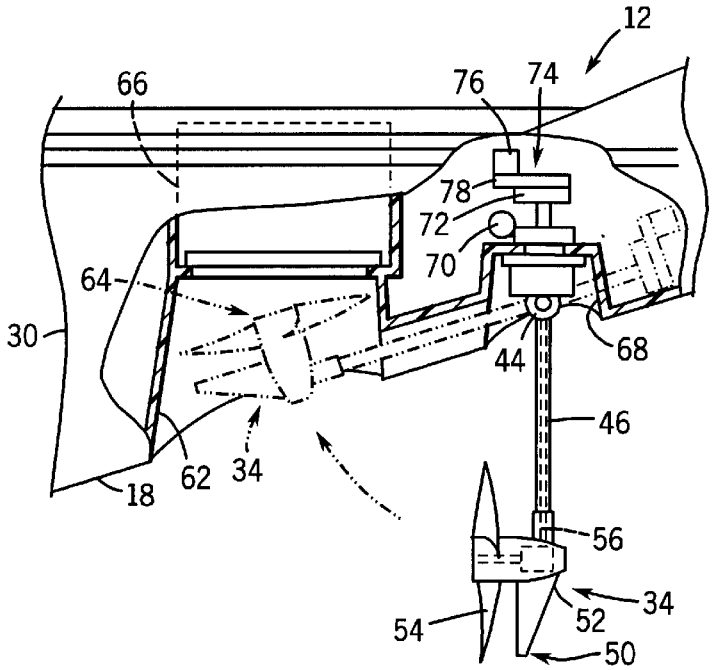
FIG. 4 illustrates a side view of an embodiment of the propulsion assembly mounted in a recessed area of the hull.

FIG. 4 illustrates a side view of the propulsion assembly 34 extending from a recessed area 68 of the hull 18. The propulsion assembly 34 is illustrated in both the thrust position 50, indicated by solid lines, and the stowed position 64, indicated by dashed lines. As discussed above, the propulsion assembly 34 is sealingly and pivotably coupled to the hull 18 by the pivotable joint assembly 44. Outboard of the hull 18, the prop 54 is drivingly coupled to the power transmission assembly 56, which extends through the housing 52 and the retractable arm 46.

On the inboard side of the recessed area 68, a pivot drive assembly 70 is coupled to the pivotable joint assembly 44 for pivoting the retractably arm 46. The pivot drive assembly 70 preferably has an electric drive, which is reversible to allow stowage and removal of the propulsion assembly 34. Alternatively, the pivot drive assembly 70 may be manually driven by a lever and gear device or a pulley assembly (e.g., via coaxial cable arrangements), or other such mechanical devices. In a preferred embodiment, the pivot drive assembly 70 is coupled to, and controlled by, the control system 36 (see FIG. 1).

To orient the prop 54 to a desired direction of thrust, an angular drive assembly 72 is coupled to the retractable arm 46. The desired orientation of the prop 54 is preferably attained by rotating the entire retractable arm 46 and the housing 52. Alternatively, the retractable arm 46 may remain fixed, while the angular drive assembly 72 rotates an inner sleeve extending lengthwise through the retractable arm 46 and coupled to the housing 52. The angular drive assembly 72 is preferably mounted inboard of the hull 18 adjacent to the pivot drive assembly 70. An exemplary embodiment of the angular drive assembly 72 includes a reversible electric drive for quietly and smoothly orienting (or steering) the prop 54. However, the angular drive assembly 72 may be driven manually or otherwise, as described above for the pivot drive assembly 70. In the illustrated embodiment, the angular drive assembly 72 and the pivot drive assembly 70 are separate units, having separate electric drives. Alternatively, a common electric drive may be used for both the angular drive assembly 72 and the pivot drive assembly 70. As with the pivot drive assembly 70, the angular drive assembly 72 is preferably coupled to, and controlled by, the control system 36 (see FIG. 1).

To drive the prop 54 and produce thrust, a drive assembly 74 is coupled to the power transmission assembly 56. The drive assembly 74 is preferably mounted inboard of the hull 18 adjacent to the angular drive assembly 72. An exemplary embodiment of the drive assembly 74 includes a drive motor 76 coupled to a gearbox 78. The drive motor 76 is preferably an electric drive unit, which may be reversible for reversing thrust and/or ridding the prop 54 of weeds and other debris. Alternatively, the drive motor 76 may be a combustion engine, or any other suitable power source for driving the prop 54. To control the drive assembly 74, the control system 36 (see FIG. 1) is preferably coupled to the drive motor 76.

While pivoting the propulsion assembly 34 to and from the stowed position 64, the power transmission assembly 56 may either bend, as with a flexible shaft, or rotate through the pivotable joint. The illustrated embodiment of FIG. 4, indicates the latter approach, while a flexible shaft may be used to provide some flexibility throughout the pivot. Alternatively, the pivotable joint 44 may provide a mechanism by which the power transmission assembly 56 disengages prior to the pivot towards the stowed position 64. In this embodiment, the pivotable joint 44 may have a male/female joint between both the angular drive assembly and the retractable arm 46, and between the drive assembly 74 and the power transmission assembly 56. The problem of pivoting is thereby solved, and added safety is provided to users who open the hatch above well 66 to examine the prop 54. Furthermore, the essentially vertical engagement and disengagement of the drive assembly 74 and angular drive assembly 72 provides a more reliable seal at the pivotable joint 44. By way of example, to maintain a seal between engagement and disengagement, an electric drive may be provided to lift the retractable arm 46 up into a cylindrical opening having annular seals (not shown). Alternatively, a similar member may be driven down over the retractable arm 46, once the propulsion assembly 34 is in the thrust position 50.

Figure 5:
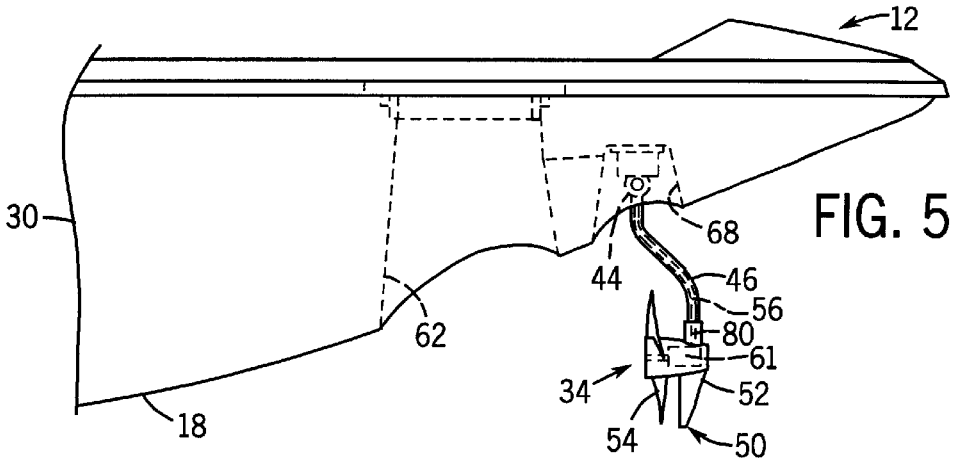
FIG. 5 illustrates a side view of an embodiment of a propulsion assembly having a curved or bent support arm in an operational position.
Figure 6:
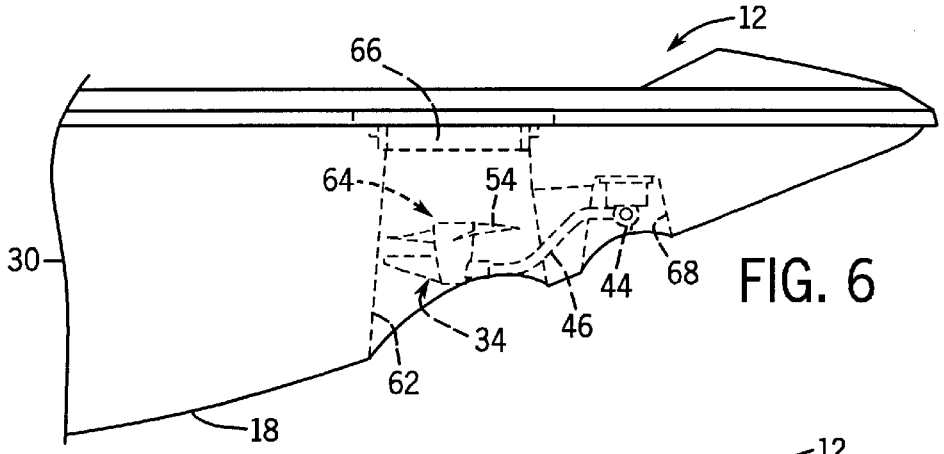
FIG. 6 illustrates a side view of an embodiment of the propulsion assembly of FIG. 5 in the stowed position, having the retractable arm bent.
Figure 7:
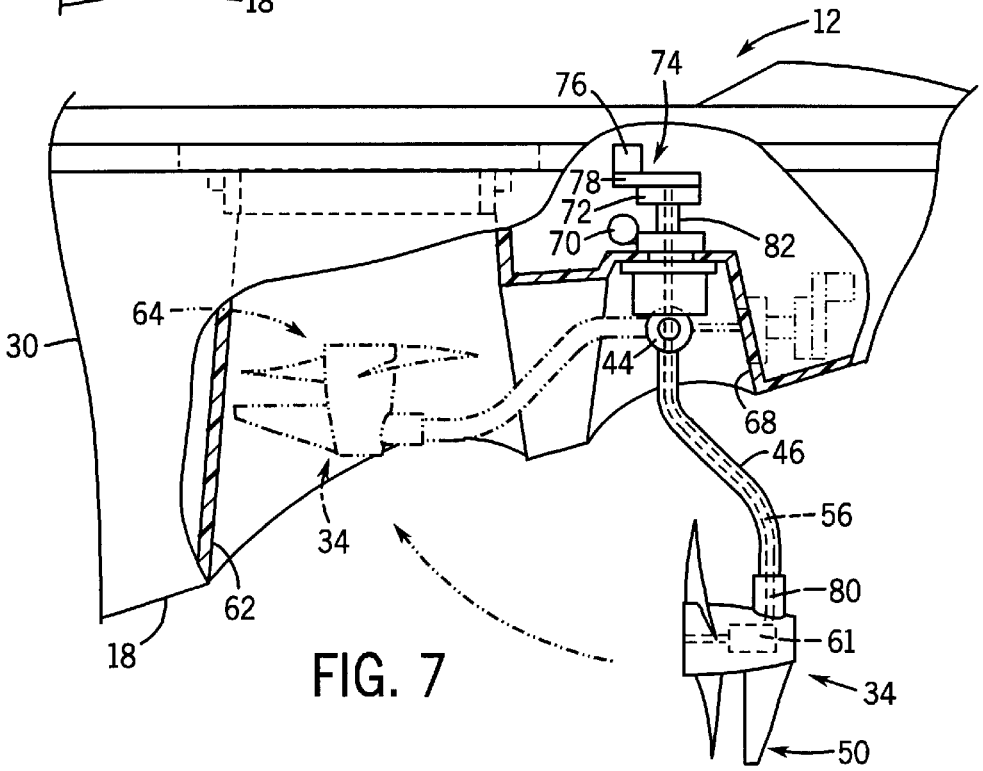
FIG. 7 illustrates a somewhat more detailed side view of an embodiment of the propulsion assembly of FIG. 5 mounted in a recessed area.

FIGS. 5–7 illustrate exemplary embodiments of the propulsion assembly 34, wherein the retractable arm 46 is curved or bent. FIG. 5 illustrates a side view of an embodiment of the propulsion assembly 34 disposed in the thrust position 50. In this embodiment, the power transmission assembly 56 preferably has a flexible shaft assembly 80 rather than separate rigid components (e.g., the drive shafts 58 and 60 drivingly coupled by the gearbox 61, as illustrated in FIG. 2). The retractable arm 46 may be bent to an appropriate curvature for a variety of reasons, such as reducing the resultant force and torque transmitted from the prop 54 to the pivotable joint 44 during operation, tailoring the retractable arm 46 to the shape of the hull 18 and reducing the tendency to become entangled in weeds.

FIG. 6 illustrates a side view of an embodiment of the propulsion assembly 34 disposed in the stowed position 64. Again, the retractable arm 46 is substantially bent in this embodiment, providing several advantages. One advantage of this embodiment is that the prop 54 is substantially horizontal in the stowed position 64, as illustrated, providing users with better access to the prop 54 for maintenance and cleaning. Another advantage is that the propulsion assembly 34 may be disposed further into the hull 18, thereby reducing drag forces in the water.

FIG. 7 illustrates a side view of an embodiment of the propulsion assembly 34 mounted in a recessed area 68 of the hull 18. Again, the retractable arm 46 is substantially bent. The propulsion assembly 34 is illustrated in both the thrust position 50, indicated by solid lines, and the stowed position 64, indicated by dashed lines. Inboard of the hull 18, the pivot drive assembly 70 is coupled to the pivotable joint 44 for pivoting the propulsion assembly between the thrust position 50 and the stowed position 64. The angular drive assembly 72 is preferably coupled to the retractable arm 46 by an extension 82. The extension 82 may be coupled to the retractable arm 46 directly, or the extension 82 may attach to, and rotate, the entire pivotable joint 44. In this exemplary embodiment, the drive assembly 74 is coupled to the power transmission assembly 56 via the flexible shaft assembly 80. The flexible shaft assembly 74 preferably extends from the prop 54 to the gearbox 78, thereby simplifying the connection and adding flexibility at the pivotable joint 44. Alternatively, the power transmission assembly 56 may be broken into sections, having either rigid shafts or flexible shaft assemblies.

Figure 8:
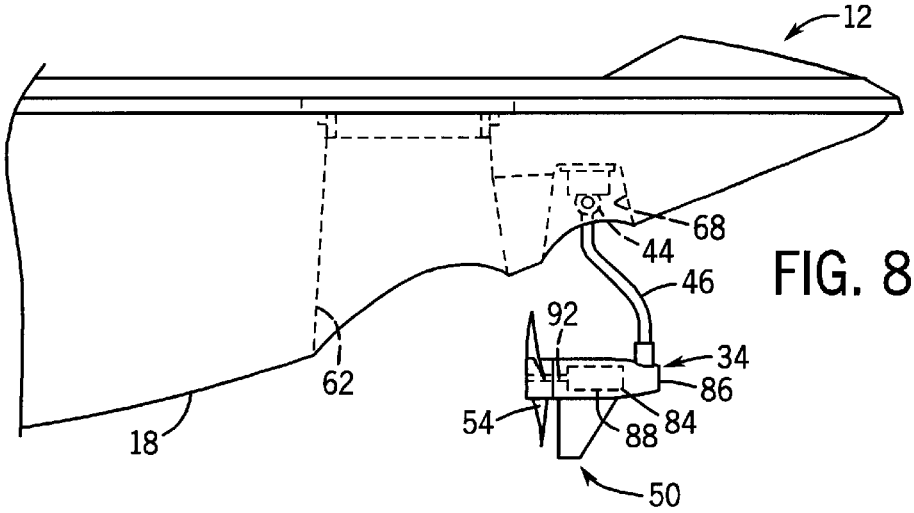
FIG. 8 illustrates a side view of a further embodiment of a propulsion assembly having a drive motor in a lower unit.
Figure 9:
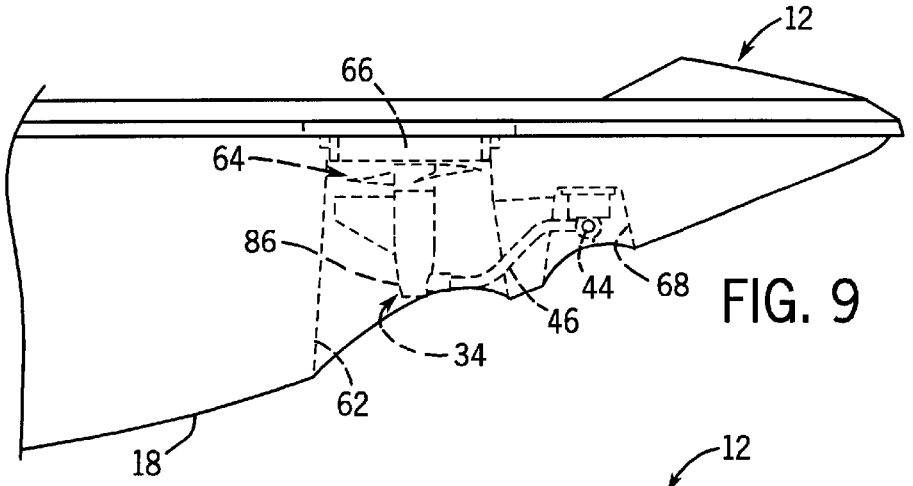
FIG. 9 illustrates a side view of the propulsion assembly of FIG. 8 in the stowed position.
Figure 10:
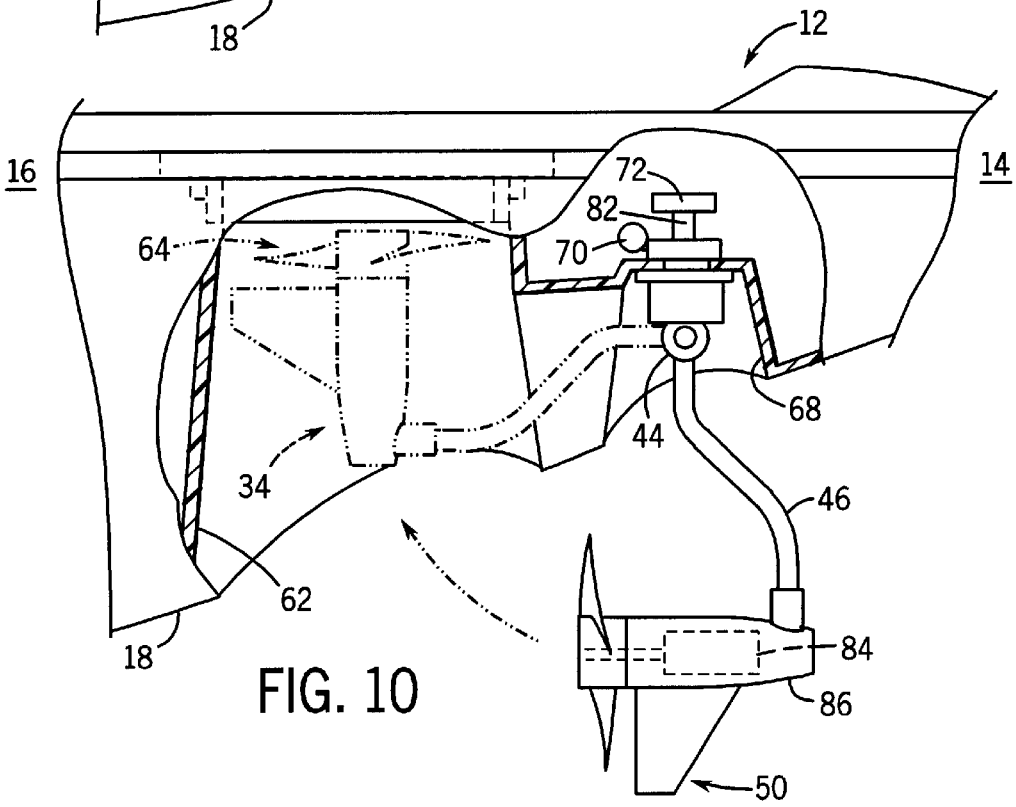
FIG. 10 illustrates a somewhat more detailed side view of the propulsion assembly of FIG. 8.

FIGS. 8–10 illustrate embodiments of the propulsion assembly 34, wherein the retractable arm 46 is again curved or bent, and a drive assembly 84 is disposed in an enlarged housing 86 to incorporate the drive or propulsion motor therein. FIG. 8 illustrates a side view of an embodiment of the propulsion assembly 34 disposed in the thrust position 50. The drive assembly 84 preferably has an electric drive 88 which transmits torque via a drive shaft 92 coupled to the prop 54. The retractable arm 46 is preferably bent such that the enlarged housing 86 is substantially centered below the pivotable joint 44, which may better balance the weight of the propulsion assembly 34. In a preferred embodiment, the drive assembly 84 is coupled to the control system 36.

FIG. 9 illustrates a side view of an embodiment of the propulsion assembly 34 disposed in the stowed position 64. As illustrated, the recessional housing 62 may be slightly enlarged to accompany the enlarged housing 86. In the stowed position 64, the enlarged housing 86 and prop 54 are disposed within well 66 for protection, maintenance and cleaning (such as via a hatch within the deck). Also, the curved shape of the retractable arm 46 may be advantageous for pivoting the propulsion assembly 34 into the recessional housing 62. Again, the curved shape of the retractable arm 46 may also be advantageous for balancing the forces and torques transmitted to the pivotable joint.

FIG. 10 illustrates a more detailed side view of an embodiment of the propulsion assembly 34 mounted in a recessed area 68 of the hull 18. Again, the retractable arm 46 is substantially bent and the drive assembly 84 is disposed within the enlarged housing 86. The propulsion assembly 34 is illustrated in both the thrust position 50, indicated by solid lines, and the stowed position 64, indicated by dashed lines. Inboard of the hull 18, the pivot drive assembly 70 is coupled to the pivotable joint 44 for pivoting the propulsion assembly between the thrust position 50 and the stowed position 64. The angular drive assembly 72 is coupled, directly or indirectly, to the retractable arm 46. For example, the angular drive assembly 72 and the retractable arm 46 may be interlinked by the extension 82, the pivotable joint 44 and/or other appropriate linkages. This embodiment is advantageous for many reasons, one of which is that the size and weight of the drive assembly is moved further back towards the stem 16, providing better balance of the weights in the watercraft and freeing up space towards the bow 14.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A propulsion system for a watercraft, the watercraft having a hull, a longitudinal centerline, and a transverse centerline, the system comprising:

a propulsion assembly for displacing water to produce thrust; and a retractable arm coupled to the propulsion assembly, wherein the retractable arm is configured for pivotable mounting to the hull forward the transverse centerline such that the propulsion assembly is pivotable between a thrust position, and a stowed position within a waterline perimeter of the hull.

2. The propulsion system of claim 1, further comprising a pivot drive assembly coupled to the retractable arm.

3. The propulsion system of claim 2, wherein the pivot drive assembly comprises an electric motor.

4. The propulsion system of claim 3, wherein the electric motor is configured for inboard mounting.

5. The propulsion system of claim 1, further comprising an angular drive assembly coupled to the propulsion assembly for orienting the propulsion assembly to produce thrust in a desired direction during operation.

6. The propulsion system of claim 5, wherein the angular drive assembly comprises an electric motor.

7. The propulsion system of claim 6, wherein the electric motor is configured for inboard mounting.

8. The propulsion system of claim 1, further comprising a power transmission assembly configured for transmitting a torque from a drive assembly to the propulsion assembly.

9. The propulsion system of claim 8, wherein the retractable arm is hollow and the power transmission assembly extends lengthwise through the retractable arm.

10. The propulsion system of claim 9, wherein the power transmission assembly further comprises a support tube in which a drive shaft is rotatably disposed.

11. The propulsion system of claim 10, wherein the drive shaft is rigid.

12. The propulsion system of claim 10, wherein the drive shaft is flexible.

13. The propulsion system of claim 1, wherein the propulsion assembly comprises a reversible electric drive motor.

14. The propulsion system of claim 1, wherein the propulsion assembly comprises a housing having a gear assembly configured for receiving a drive shaft and for transmitting torque to a prop.

15. The propulsion system of claim 1, wherein the propulsion assembly comprises a housing having a flexible shaft assembly configured for transmitting torque from a drive shaft to a prop.

16. The propulsion system of claim 1, wherein the retractable arm is configured for a pivotable mounting to the hull along the longitudinal centerline.

17. The propulsion system of claim 1, further comprising a recessional housing configured to sealingly mount to the hull forward the transverse centerline, wherein the recessional housing is adapted for recessionally securing the propulsion assembly to reduce drag when not in use.

18. A watercraft comprising:

a hull having a recessional housing forward a transverse centerline of the watercraft;

a propulsion assembly for displacing water to produce thrust; and an arm pivotably coupling the propulsion assembly to the hull, wherein the arm is configured to pivot the propulsion assembly between a thrust position and a stowed position within the recessional housing.

19. The propulsion system of claim 18, further comprising a pivot drive assembly coupled to the arm.

20. The propulsion system of claim 18, further comprising an angular drive assembly coupled to the propulsion assembly for orienting the propulsion assembly to produce thrust in a desired direction during operation.

21. The propulsion system of claim 18, further comprising a power transmission assembly configured for transmitting a torque from a drive assembly to the propulsion assembly.

22. The propulsion system of claim 21, wherein the arm is hollow and the power transmission assembly extends lengthwise through the arm.

23. The propulsion system of claim 22, wherein the power transmission assembly comprises a rigid drive shaft rotatably supported by a bearing assembly.

24. The propulsion system of claim 22, wherein the power transmission assembly comprises a flexible shaft assembly.

25. The propulsion system of claim 18, wherein the propulsion assembly comprises a housing having a gear assembly coupled to the power transmission assembly, wherein the gear assembly is adapted for transmitting the torque to a prop.

26. A method of displacing a watercraft, the watercraft having a hull and a transverse centerline, the method comprising:

pivoting a retractable propulsion assembly mounted forward of the transverse centerline from a stowed position to an operational position, wherein in the stowed position at least a portion of the propulsion system is received within a recessional housing of the hull, and wherein the step of pivoting includes removal of the portion of the propulsion system from the recessional housing; and powering an electric drive motor of the propulsion assembly to drive a prop and thereby to produce a thrust in a desired direction.

27. The method of claim 26, further comprising rotating the propulsion assembly to a desired orientation to produce the thrust in the desired direction.

* * * * *